United States Patent [19]

Hill

[11] Patent Number: 4,467,154

[45] Date of Patent: Aug. 21, 1984

[54] GRAVITY SWITCH AND METHOD OF MAKING SAME

[75] Inventor: Clinton W. Hill, Romeo, Mich.

[73] Assignee: U. S. Plastics Corporation, Mt. Clemens, Mich.

[21] Appl. No.: 491,492

[22] Filed: May 4, 1983

[51] Int. Cl.[3] ..... H01H 35/02

[52] U.S. Cl. ..... 200/61.45 R; 200/61.52; 200/61.83; 200/DIG. 29

[58] Field of Search ..... 200/61.45 R, 61.45 M, 200/61.52, 61.83, DIG. 29

[56] References Cited

U.S. PATENT DOCUMENTS

| | | | |
|---|---|---|---|
| 1,971,585 | 8/1934 | Sureng | 200/61.52 X |
| 2,277,352 | 3/1942 | Posey | 200/61.52 |
| 2,601,142 | 6/1952 | Hubbard | 200/61.83 X |
| 4,001,185 | 1/1977 | Mitsui et al. | 200/61.52 X |
| 4,042,796 | 8/1977 | Zink | 200/61.52 X |

FOREIGN PATENT DOCUMENTS

| | | | |
|---|---|---|---|
| 676356 | 6/1939 | Fed. Rep. of Germany | 200/61.52 |

*Primary Examiner*—J. R. Scott

*Attorney, Agent, or Firm*—Jay C. Taylor

[57] ABSTRACT

A molded cup-shaped dielectric member and a cup-shaped conductor member are pressed together to comprise an integral dimensionally stable sealed enclosure for a contact member movable axially therein for selectively making or breaking an electrical connection between the cup-shaped conductor member and a second conductor extending axially through and sealed within the base of the cup-shaped dielectric member. The axially outer surfaces of the base and the second conductor comprise electrical contacts for a gravity actuated switch. The overall axial dimension between the axially outer surfaces is obtained by telescoping the cup-shaped members coaxially together until the preselected axial dimension is obtained. In one embodiment the cup-shaped dielectric member has a cylindrical base and a coaxial diametrically reduced cylindrical portion extending from the cup-shaped base to an upper opening. The conductor is telescoped over the diametrically reduced portion in fluid sealing relationship. The enclosure has an interior cylindrical surface of optimum diameter for the axially movable contact member comprising a metallic ball also of optimum diameter for any given size switch.

13 Claims, 10 Drawing Figures

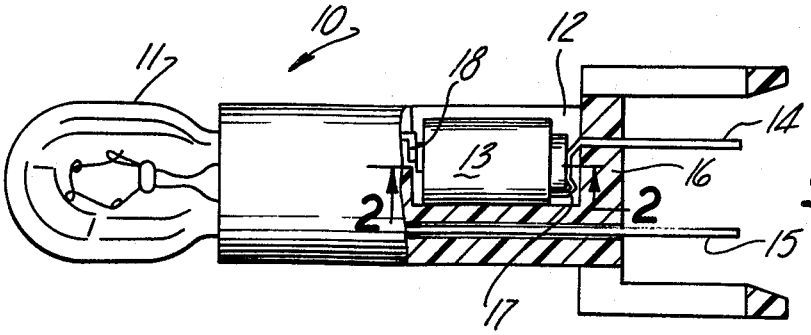
Fig-1
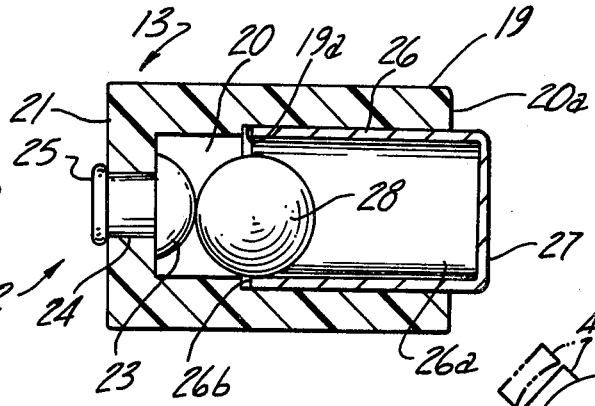
Fig-2
Fig-3
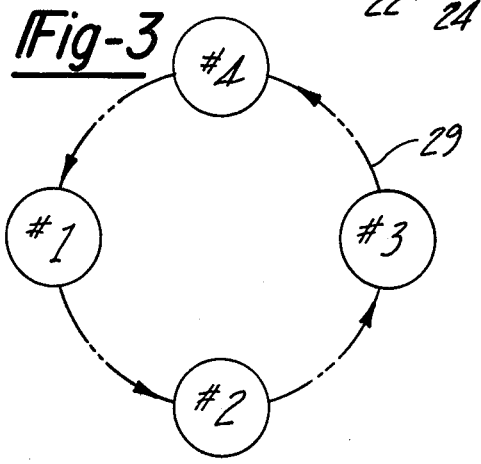
Fig-4
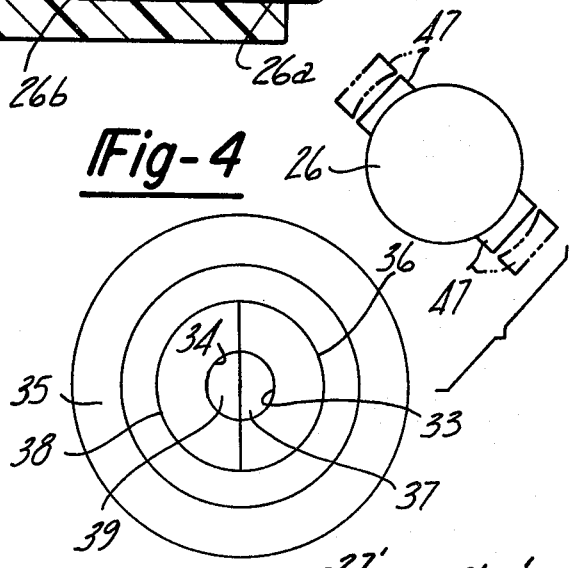
Fig-5
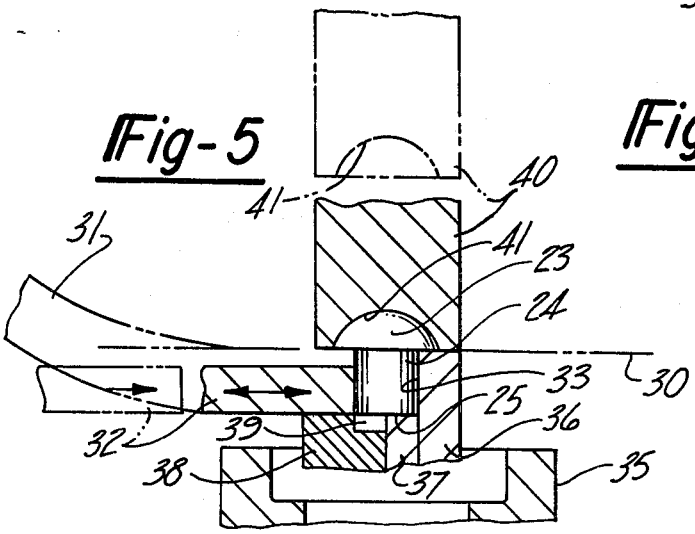
Fig-10
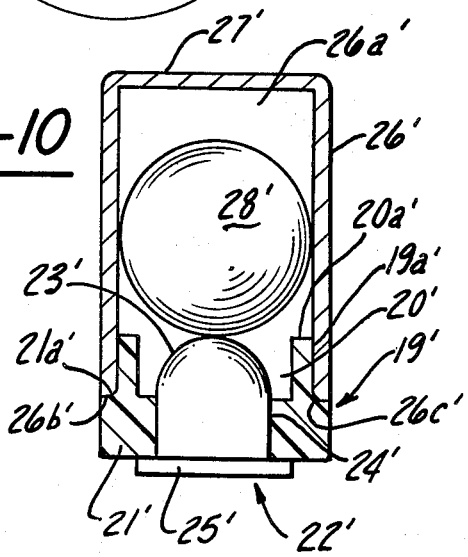

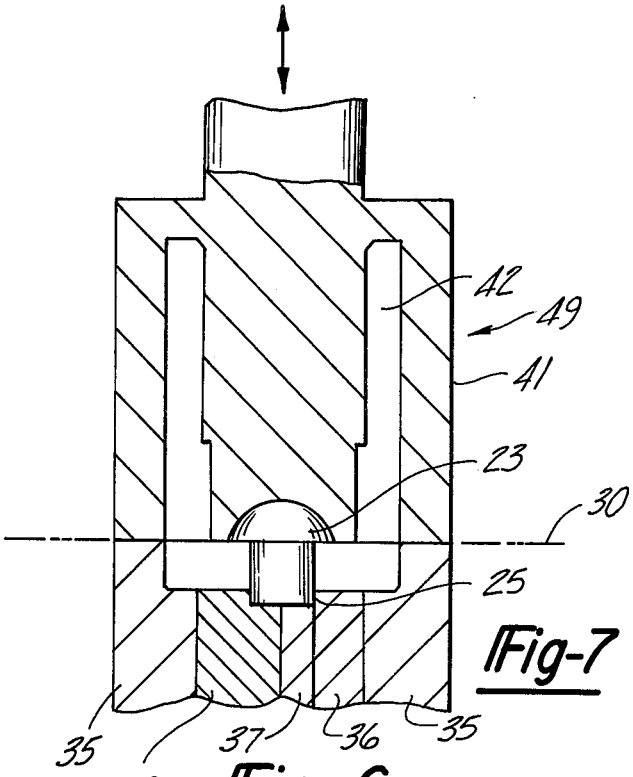
Fig-6
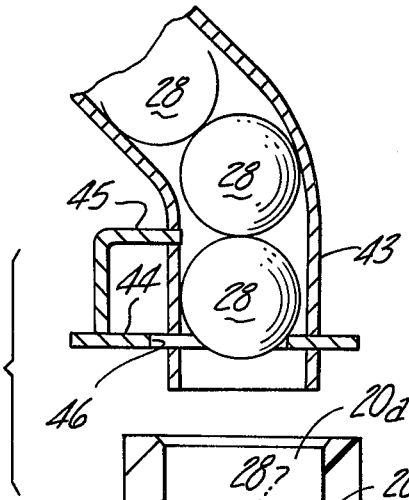
Fig-7
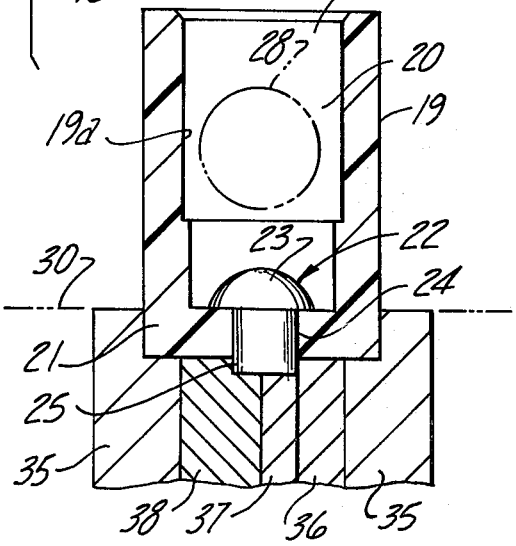
Fig-9
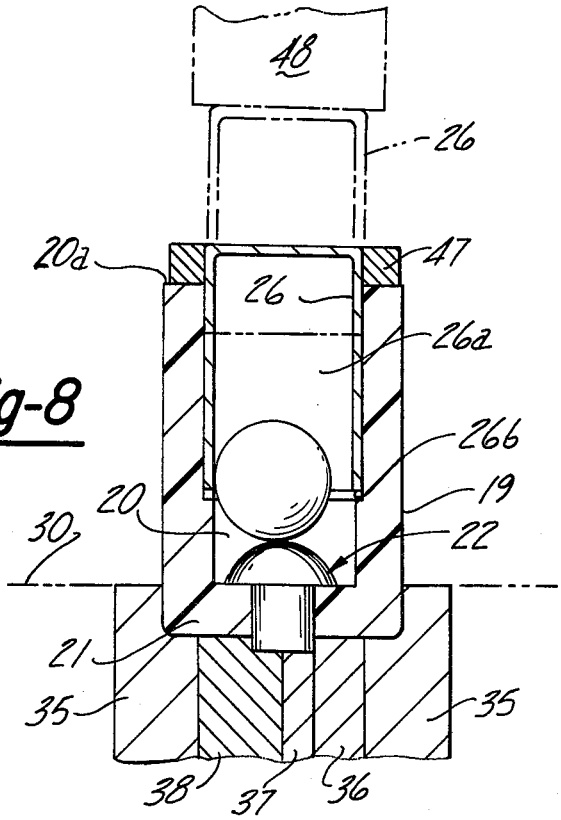
Fig-8
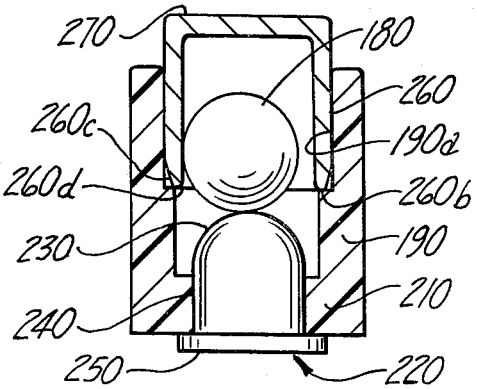

GRAVITY SWITCH AND METHOD OF MAKING SAME

This invention relates to improvements in a gravity operated electrical switch and to a method for its manufacturer and in particular to such a switch of small size adapted to replace or to be interchangeable with a typical mercury switch of the type adapted to be exposed to the weather and used with an automobile hood or deck lid wherein the switch automatically completes or breaks an electrical circuit when the lid is opened or closed.

BACKGROUND AND OBJECTS OF THE INVENTION

Important objects of the present invention are to provide an improved switch of the above type characterized by simplified low cost design and construction and that is light in weight, compact, highly reliable, and capable of economical manufacture by automated mass production procedures; to provide such a switch contained within an improved cylindrical plastic housing that minimizes the possibility of shorting to ground and effectively seals the electrical contacts from the atmosphere and corrosion; to provide such a switch having improved contact elements including a spherical contact member or metallic ball movable by gravity within a cylindrical electrical conductor secured coaxially to the cylindrical housing such that operation of the switch is assured regardless of the rotational position of the housing axis; and to provide an improved economical and automated method of manufacturing such a switch wherein dimensional tolerances between the external electrical contacts are closely maintained without recourse to precise and expensively maintained dimensions for the component parts.

Among the problems involved in the substitution of such a gravity switch for a mercury switch are ball sticking or a welding effect and high millivolt drop across the electrical contacts. Ball sticking or welding of the ball to the contacts at the "on" or a closed circuit position impairs gravity induced movement of the ball to the "off" or open circuit condition. Also a comparatively high voltage drop between the ball and the switch contacts at the closed circuit condition results in loss of electrical power, or luminous intensity when the switch is employed with an electric light.

The above problems are overcome in accordance with the present invention by providing means for significantly increasing the contact pressure between the ball and the switch contact elements. Inasmuch as the overall switch dimensions are severely limited by the requirement of maintaining interchangeability with customarily employed mercury switches, the design of the ball switch is critical.

Other objects accordingly are to provide an improved switch design which, without increasing the external dimensions of the switch, enables use of a larger diameter ball contact element of correspondingly greater weight, which in turn has been found to reduce the voltage drop across the ball contacts materially when the switch is tilted to the "on" position. In consequence, a comparatively costly lead ball, which has been heretofore preferred in small switches because of its high specific gravity, can be replaced by a larger, heavier, and less costly brass ball which reduces voltage loss across the contacts and likewise the welding effect and enables efficient operation of the switch with larger current flow than heretofore. By suitably plating the ball element, as for example with zinc, tin, or cadmium, and by sonic cleaning of the contact elements immediately prior to their assembly, the welding effect and consequent ball sticking are further reduced and optimum electrical conductivity through the switch is achieved.

Other objects of this invention will appear in the following description and appended claims, reference being had to the accompanying drawings forming a part of this specification wherein like reference characters designate corresponding parts in the several views.

PRIOR ART

Although applicant is not aware of any switch comparable in simplicity and effectiveness to the present invention, sealed gravity actuated switches comprising a conducting shell arranged coaxially within an insulating shell are common, as illustrated for example in Hobbs U.S. Pat. Nos. 2,206,094 and 2,228,456 and in Zink U.S. Pat. No. 4,042,796. In particular the prior art does not teach the construction of a cup-shaped dielectric member and a cup-shaped conductor pressed together in axially telescoping relationship at an interference fit, whereby the two cup-shaped members are fixed with respect to each other to comprise an integrated dimensionally stable sealed housing for a contact element movable axially within the members and adapted for selectively making or breaking an electrical connection between the cup-shaped conductor and a second conductor extending axially through the base of the cup-shaped dielectric member whereby the axially outer surfaces of the electrical contacts for the switch, comprising the base of the cup-shaped conductor and the second conductor, are available for making electrical contact with a pair of axially spaced contacts within a container for the switch, and also whereby the overall axial dimension between said axially outer surfaces of the switch contacts may be readily preselected and maintained in production without recourse to closely maintained and costly axial tolerances in the fabrication of the cup-shaped members. Likewise there is no suggestion in the prior art of such a switch wherein the dielectric cup-shaped member has a cylindrical portion of reduced outer diameter with respect to its base and extending therefrom for a comparatively short axial extent to its open end, and wherein the conducting member is sleeved or telescoped over said reduced outer diameter portion in tightly fitting sealing engagement, thereby to reduce the costly dielectric plastic material to a minimum and achieve the maximum internal diameter for the conducting member without increasing the overall outer diameter of the switch.

BRIEF DESCRIPTION OF THE DRAWINGS

FIG. 1 is a side elevational view, partly broken away to show details of construction of a housing for an electric lamp and gravity operated switch embodying the present invention.

FIG. 2 is a sectional view along the longitudinal axis of the switch, taken in the direction of the arrows substantially along the line 2—2 of FIG. 1.

FIG. 3 is a schematic plan view illustrating multiple stations in the automated manufacturer of the switch of FIG. 2.

FIG. 4 is a schematic plan view of one of the stations illustrated in FIG. 3.

FIGS. 5, 6, 7 and 8 are schematic views illustrating processes in the automated manufacturer of the switch at four successive stations.

FIGS. 9 and 10 are sectional views similar to FIG. 2, showing modifications of the invention.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

DESCRIPTION OF A PREFERRED EMBODIMENT

Referring to the drawings, a plastic housing 10 is illustrated in FIG. 1 having a conventional socket for a small electric light bulb such as a conventional wedge base bulb 11 adapted for operation at approximately one ampere in a twelve volt D.C. circuit, and a cavity 12 for removably receiving a conventional gravity operated mercury switch, or the switch 13 described in detail below.

The housing 10 is provided with a pair of electrical leads 14 and 15 adapted for example to be connected respectively with the positive terminal of a battery and to ground. The lead 14 extends through the base 16 of the housing 10 and is electrically connected with a conventional resilient or spring contactor 17 at one axial end of the cavity 12. A second contactor 18 which may also be resilient is confined within the housing 10 at the opposite axial end of the cavity 12 and is arranged for electrically contacting one contact element of the bulb 11.

The lead 15 extends through the body of the housing 10 and is arranged for contacting a second electrical contact of the bulb 11 to complete an electrical circuit through the bulb 11 when the switch 13 is electrically closed, as described below. Except for the switch 13, the details of the housing 10 and its electrical contacts may be conventional.

Referring to FIG. 2, details of the switch 13 are illustrated comprising a one-piece injection molded cup-shaped plastic housing 19, which may comprise a thermoplastic such as fiber-glass filled polyester resin capable of expanding slightly and softening when heated and of shrinking slightly and hardening when cooled to room temperature, or a Nylon TM 103 and preferably for dimensional stability a Noryl TM resin. The housing 19 is cylindrical in cross section to define an enclosure 20 open at one end **20*a* and closed at its opposite end or base 21**.

Suitably secured within the base 21 and effecting a fluid tight seal therewith is a one-piece brass rivet-shaped contact means or electrical conductor 22 of circular section having an enlarged head or interior contact 23 adjacent the interior of the base 21, a connecting portion 24 extending coaxially through the base 21, and an exterior contact 25 which may be slightly swaged if desired to clamp the base 21 firmly between the contacts 23 and 25 and to assure a fluid sealing engagement between the material of the base 21 and portion 24 entirely around its circumference in the event the conductor 22 is not molded as an insert within the base 21, as described below.

If desired, the conductor 22 may be assembled with the housing 19 by forcing the small end of the conductor 22 through the opening therefor in the base 21, as for example in some instances which the housing 19 and base 21 are warm, as for example between about 100° and 180° F., depending upon the plastic, or the base 21 may be warmed around its opening by first heating the conductor 22 and forcing it through the base opening. In any event, when the base 21 cools and shrinks around the connecting portion 24, a fluid tight bond and seal is effected between the portion 24 and the adjacent plastic of the base 21. Thereafter if desired, the exterior contact portion 25 may be swaged to effect the aforesaid clamping and enhance the seal.

A brass cup-shaped second electrical conductor or contact means 26 of cylindrical cross section defines an enclosure **26*a* open at its inner end 26*b* and closed at its axially opposite base 27 or exterior contact. A spherical lead conductor or ball 28 rolls freely within the enclosure 26*a*, which is dimensioned so that when the ball 28 is in contact with the interior contact 23, it will also be in contact with the cylindrical interior sidewall of the conductor 26. The interior surface of the cylindrical enclosure 26*a* thus serves as a guide for the ball 28** in electrical contact therewith at all times.

Obviously upon tilting of the longitudinal axis of the switch 13 clockwise or counterclockwise from the horizontal position shown, the ball 28 will roll to an open switch or closed switch position. Preferably also the lead ball 28 comprises an alloy containing 2% antimony which increases the hardness and durability of the ball 28 without significantly decreasing its essential weight. The conductor 22 is preferably zinc coated to facilitate identification of the switch polarity. Also preferably, the conductor 26 is dimensioned to effect a fluid sealing interference fit between its cylindrical sidewalls and the cylindrical sidewalls of the plastic housing 19. Thus the interfitting cylindrical walls of the members 19 and 26 may be telescoped together coaxially with moderate force to assure dimensional stability for the switch 13 and a fluid tight seal between the cylindrical sidewalls of the members 19 and 26. Similarly to the heating of the base 21 by first heating the conductor 22, the housing sidewalls may be heated by first heating the conductor 26 and pressing the latter coaxially into the enclosure 20 to complete the assembly of the members 19 and 26. On the other hand, the Nylon TM 103 and preferred Noryl TM are non-galling and sufficiently resistant to abrasion so that the housing 26 may be readily assembled with the conductors 25 and 26 by the pressing operations at room temperature.

It is believed to be apparent from the foregoing that the axially outer or exterior surfaces of the contact 25 and base 27 comprise electrical contact surfaces adapted to be frictionally confined tightly between the contacts 17 and 18, at least one of which may be resilient, thereby to enable selective completion of an electric circuit through the lamp 11 upon appropriate tilting of the housing 10. By virtue of the cylindrical sidewalls of the cup-shaped conductor 26, the ball 28 is guided axially within the switch 13 in electrical contact with the conductor 26 regardless of the rotational position of the cylindrical axis of the switch 13 within housing 10.

The housing 19 may be formed by conventional injection molding processes. The conductor 22 and the cup-shaped conductor 26 may be formed by conventional stamping or drawing operations. By virtue of the coaxial arrangement of these parts and the location of the base contact 27 as shown, the conductor 26 may be forced coaxially into the housing 19 until a desired preselected overall axial length for the switch 13 is obtained, without particular regard to the axial length of either the housing 19 or conductor 26. It is only essential that the members 19 and 26 be damensioned axially with regard to the eventual overall desired axial length of the switch 13 so that in the final assembled position, the external contact base 27 will project slightly endwise from the open end 20*a* of the housing 19. The arrangement described thus reduces the necessity for maintaining close production tolerences for the axial length of the members 19 and 26, with resulting production economies.

FIGS. 3 through 8 illustrate the apparatus and a preferred method for manufacturing the switch 13 at four progressive work stations located 90° apart around a rotating conveyer 29. The upper parts of a multiple-part injection molding die 49, FIG. 6, at each station above a partition or datum plane 30 may be non-rotatable. The die parts below the datum plane 30 are progressively indexed through the Stations 1, 2, 3, and 4 by rotation of the carrier 29.

Station #1 is a conductor feeding station whereat the conductors 22 are fed one at a time from a hopper, not shown along a feed track 31 to the position illustrated in FIG. 5 by operation of a horizontally reciprocating plunger 32. In FIGS. 5–8, the connection 24 between the contacts 23 and 25 has the same diameter as the contact 25. In other words, the contact 25 is not swaged or enlarged, which is optional and immaterial to the method described below.

When the rotating conveyer 29 indexes the lower parts of the die 49 to the #1 Station, a single conductor 22 is fed to a position in advance of the plunger 32, which is initially retracted to the phantom position shown. The plunger 32 is then activated to move to the right in FIG. 5 and locate the conductor 22 as shown against a vertical semi-circular cylindrical wall 33 of the die 49. The latter comprises vertically movable parts 35, 36, 37, and 38 carried by conveyer 29 and located initially as illustrated in solid lines, FIG. 5, at Station #1.

The aforesaid rightward movement of plunger 32 slides the conductor 22 in the upright position shown along a horizontal portion of track 31 flush with the top of die part 38, thence along the latter top and into position with the right half of the contact 25 seated on a mating upper horizontal semi-circular surface of cylindrical die part 37 and against the vertical wall 33 of the die part 36. The left half of the contact 25 will then overlie a mating semi-circular cylindrical cavity 39 in the upper interior portion of die part 38, see also FIG. 4. The conductor 22 is thus supported and clamped radially between the wall 33 of die part 36 and plunger 32.

A vertically movable locating plunger 40 having a lower cavity 41 shaped to closely confine the upper or interior surface of the contact 23 of conductor 22 now moves downwardly from the phantom position, FIG. 5, to the solid line position, thereby to secure the conductor 22 against inadvertent movement upon the subsequent retraction of plunger 32 to the phantom position of FIG. 5 and the movement of the die parts 36 and 38 to their solid line positions illustrated in FIG. 6. At such positions, the contact 25 of conductor 22 is secured between mating half cylindrical surfaces 33 and 34 of mold portions 36 and 38 respectively, FIG. 4. The surface 34 defines a vertical wall of recess 39.

After the contact 25 is secured between surfaces 33 and 34, plunger 40 is retracted to the phantom position of FIG. 5 and the die conveyor 29 indexes the lower die parts 35–38 to the #2 station, FIG. 6, whereat a vertically movable upper die part 41 is moved downwardly and the die part 35 is moved upwardly to meet at the partition surface 30, FIG. 6.

The die parts 35–38 and 41 at the FIG. 6 position cooperate to provide a mold cavity 42 having the shape of the desired housing 19. Also as illustrated in FIGS. 6 and 7, the lower die parts 35–38 cooperate to define the cavity for the housing base 21 and support the latter after the molding operation. The plastic that eventually hardens to provide the housing 19 is then injected in a fluid condition at elevated temperature and pressure into the cavity 42 by conventional means to form the housing 19 with its base 21 around the connecting portion 24 and bonded thereto in fluid sealing engagement. Formation of the housing 19 with the insert 22 by injection molding assures rapid and complete filling of the cavity 42 and sealing around the brass insert portion 24. Depending upon the plastic, typical molding temperatures and pressures of 500° to 540° F. and 500 to 1500 psi, may be employed. Preferably a plastic is selected that can be molded satisfactorily at about 1000 psi.

Upon completion of the injection molding, the upper die part 41 is retracted vertically to expose the housing 19 in an upright position as illustrated in FIG. 7. The rotating carrier 29 is then indexed with the housing still confined at its base 21 within the lower die parts 35–38 to the #3 Station, FIG. 7, whereat the upper opening 20*a* is aligned with a ball feeder 43. The latter comprises a chute and a detente mechanism 44, 45 which is then moved to the right to center an opening 46 in the lower detente 44 with the chute 43 to enable release of one of the balls 28 into the housing 19. Simultaneously the upper detente 45 moves into the chute to prevent release of a second ball 28. Thereafter the detente mechanism 44, 45 returns to its solid line position illustrated in FIG. 7 and the die conveyor 29 indexes the lower die parts with the housing 19 and ball 28 to the FIG. 8 position of the #4 Station.

At Station #4, the brass conductor 26 is fed with its open end 26*b* down into a position between a pair of diametrically spaced gripping members 47, phantom position FIG. 4. Thereafter the gripping members 47 are activated to move to the solid line position, FIG. 4, and grip the conductor 26 at diametrically opposite sides adjacent its lower open end and move the conductor 26 into coaxial alignment with the upwardly opening housing 19 as illustrated in phantom FIG. 8. A vertically movable plunger 48 is then moved downwardly from the phantom position in coaxial alignment with the conductor 26, FIG. 8, to force the latter downwardly and coaxially into the upper open end 20*a* until the overall preselected axial dimension for the assembled switch 13 is obtained.

The cylindrical sidewalls of the conductor 26 are dimensioned to effect an interference fit with the interior of the housing 19, as for example at the region of the cylindrical enlargement or offset 19*a* that may be provided optionally to accommodate the cylindrical sidewall of conductor 26. Also to avoid reheating, the insertion of the conductor 26 into the housing 19 may be done while the latter is still warm from the molding operation, as for example between about 100° and 180° F., and the plastic of the housing 19 is still sufficiently flexible to enable insertion of the conductor 26 without excessive force. When the housing 19 cools and shrinks around the conductor 26, a fluid sealing bond between the members 19 and 26 and a unitary dimensional stable switch 13 results. By reason of the light weight of the conductor 26, comparatively little force is required by the gripper 47 to hold and locate the conductor 26 in coaxial alignment with the housine 19. Accordingly when the plunger 48 moves downwardly, the conductor 26 readily slides downwardly relative to the grippers 47.

Upon completion of the downward movement of plunger 48, the latter and the grippers 47 are retracted to their phantom positions illustrated in FIGS. 4 and 8, in preparation for the next successive conductor 26 upon the next successive action at Station #4. Also the die parts 36, 37, and 38 are then moved upwardly to eject the assembled switch 13 from the die. The switch 13 is then blown into a retaining basket, examined for defects, tested for performance, and shipped to the consumer.

Referring to FIG. 9, a preferred production version of the present invention is illustrated wherein the various parts are identified by numerals corresponding to the identifying numerals for the parts previously described but multiplied by a factor of ten. Likewise the various parts operate and may be manufactured the same as described above, with differences noted below. For example the brass cup-shaped conductor 260 is provided with a slightly chamfered outer edge 260*c* that tapers toward the inner end 260*b* and the latter is provided with an annular rounded inner edge 260*d*. The chamber 260*c* serves as a guide and leading edge to facilitate the initial insertion of the conductor 260 into the open end 200*a* of the plastic housing 190 and avoids cutting of the plastic material during the assembly operation, FIG. 8. The rounded edge 260*d* prevents interference with movement of the ball 180, particularly in the event that the plane of the inner end 260*b* is adjacent the center of the ball 180 at the contact position when the switch 13 is finally assembled.

The conductor 220 is provided with an enlarged exterior contact base 250 and is forced into an opening in the housing base 210 that provides an interference fit with the circular cylindrical connector 240, so that when the parts are assembled as described above by forcing the contact surface 230 through the aforesaid opening, a fluid tight seal will be affected between the plastic base 210 and the cylindrical portion 240 entirely around the latter. The inner contact end 230 of the conductor 220 is rounded spherically with a radius comparable to the radius of the ball 180 and serves as a rounded guide upon its insertion coaxially to the assembled position shown, FIG. 9. Also preferably the brass conductor 220 is zinc or cadmium coated to facilitate electrical conductivity and identification of polarity.

The spherical contact surface 230 assures an essentially point contact with the ball 180 and maximum gravity induced pressure loading therebetween when in electrical contact. Such maximum pressure contact is particularly important in a small light weight gravity operated switch of the type described capable of replacing a mercury switch, as for example in the housing 10, FIG. 1. Accordingly the ball 180 is preferably a heavy material such as lead or the lead-antimony alloy described which is also a good electrical conductor. For a low amperage light bulb of the type illustrated in FIG. 1 for use with an automobile under-the-hood or rear deck illumination in a typical twelve volt DC circuit, the ball 180 will usually be less than a quarter of an inch in diameter and preferably less than two tenths of an inch for the sake of economy of material.

In the preferred construction illustrated in FIG. 9, the lead-antimony ball 180 weighs 0.61 grams, has a diameter of 0.19 inches, and is sonic cleaned prior to being confined within the cavity 260*a* of the assembled switch 13 to remove any accumulated dirt or oxides and to assure good electrical contact with the surface 230. The internal diameter of the cup-shaped conductor 260 is between 0.195 and 0.200 inches, enabling the ball 182 to roll freely therein. The diameter of the spherical surface 230 is $0.175 \pm 0.001$ inches. The diameter of the cylindrical connector portion 240 is the same as the radius of the spherical portion 230. The cylindrical opening in the base 210 for the portion 240 is formed during the injection molding of the housing 190 to effect a cylindrical interference diameter of 0.173 inches within a tolerance of plus 0.000 and minus 0.003 inches, thereby to effect the aforesaid fluid tight seal.

The housing 190 is molded from the aforesaid resin separately from the conductors 220 and 260 to provide an outer diameter for the switch 13 of approximately 0.37 inches. The internal diameter of the enlarged or radially offset cylindrical inner surface 190*a* is dimensioned to effect a diametrical interference of, 0.005 inches with the outer diameter of the cylindrical wall of the cup-shaped conductor 260. The radial shoulder at the inner end of the offset enlargement 190*a* provides a movement limiting stop for the conductor 260 in the event the latter should be inadvertently forced axially too far into the housing 190. In such an event, although the overall axial dimension of the resulting switch 13 might be less than preferred, the spring contactor 17 of FIG. 1 will be adequate to compensate for the shorter axial length and effect the necessary electrical contact with the base 250.

The aforesaid interference dimensions in conjunction with the molded resin housing assure the necessary fluid seals between the housing 190 and conductors 220 and 260. Also by virtue of the Nylon TM or Noryl TM housing 190, its assembly with the conductors 220 and 260 by forcing the latter coaxially thereinto as described may be accomplished at room temperatures.

The foregoing describes several important aspects of the present invention that enable the production of an improved ball or gravity switch wherein it is important to confine a major portion of the brass shell 26 or 260 within the dielectric housing 19 or 190, as for example where the possibility of inadvertent electrical grounding or shorting of the shell 26, 260 is a problem. Where exposure of the major portion of the conducting cup-shaped shell is not a problem, additional significant improvements in a ball or gravity switch are illustrated in FIG. 10 wherein similar parts function in the manner of those already described and are identified by the same reference numerals, distinguished by a prime mark.

Thus in FIG. 10, a cup-shaped cylindrical brass shell 26′, 27′ enclosing space 26*a*′ for a conducting ball 28′ is telescoped or sleeved over the outer cylindrical surface of a diametrically reduced portion 19*a*′ of a cup-shaped dielectric housing member 19′. The inner edge 26*c*′ of the annular end 26*b*′ is chamfered to facilitate initiation of the telescoping assembly. The portion 19*a*′ extends axially from the base 21′ to its open end 20*a*′, which terminates at approximately the level of the innermost portion of the spherical surface of the brass contact 23′, or extends for an axial distance approximately equal to or less than the radius of the ball 28′. The axial extent of the reduced diameter portion 19*a*′ is preferably no more than is required to effect a fluid tight seal with the inner cylindrical surface of the shell 26' pressed thereon at an interference fit. In consequence, a minimum of the dielectric material is required.

In the FIG. 10 structure, the dielectric from which the housing part 19' is molded preferably comprises the above mentioned Noryl TM because of its dimensional stability and its capability of being formed within close tolerances by conventional molding processes. In other respects the part 19' cooperates with the brass contact 22' in the manner of the aforesaid parts 19, 190 cooperating with the contacts 22, 220.

The annular shoulder 21a' comprising the portion of the base 21' around the reduced diameter portion 19a' serves as an abutment to stop axial movement of the shell 26' drying assembly. By virtue of the dimensional stability of the Noryl TM material of the part 19' and the feasibility of forming the brass shell 26' within close tolerances, it is usually unnecessary to provide an adjustment gap between the shoulder 21a', and the open end 26b' of the shell 26'. Furthermore the close tolerance to which the Noryl TM can be molded facilitates sealing between the housing portions 19a' and 26'.

In the event that adjustability of the overall axial length of the switch is desired, suitable clearance between shoulder 21a' and end 26b' may be provided. The housing members 19' and 26' may then be assembled by selective telescoping as described above in regard to FIG. 8. The contact 22', with or without an enlarged exterior contact 25', may be molded in position within the base 21', or the contact surface 23' may be forced axially into position through the opening in the base 21' around the connector portion 24', as described above in regard to the contacts 22, 220.

It is to be observed that by virtue of the construction shown in FIG. 10, without increasing the overall outer diameter of the switch, the diameter of the ball 18' may be increased significantly. Thus the 3/16" 0.61 gram lead ball 18 can feasibly be replaced by a less costly 5/16" 2.17 gram brass ball 18' that significantly reduces the voltage drop across the ball contacts and enables increased current flow through the closed switch without increasing ball sticking or welding. Furthermore the assembled switch is readily received within the cavity 12, FIG. 1.

Although the greater weight of a lead ball 18' would reduce ball-contact voltage loss even more than the brass ball 18' and could be used where the additional cost is warranted, the more economical brass ball 18' performs adequately in the typical installation. Zinc or cadmium plating of the ball 18' and contact 22' further reduces power loss and the welding effect by eliminating the corrosion tendency of the unplated brass contacts. No appreciable welding effect between the interior of shell 26' and ball 18' occurs because these elements are in electrical contact at all times and make or break of the electric circuit does not take place therebetween. Finally, to eliminate dust, flashing, and other foreign contamination of the switch contact elements, these are preferably cleaned by known sonic processes immediately before assembly of the switch to assure optimum operating efficiency.

I claim:

1. A gravity switch for opening or closing an electrical circuit in accordance with the inclination of the axis of the switch from a horizontal position comprising a cup-shaped dielectric member having axially extending sidewalls forming an enclosure, a base closing one axial end of said enclosure, and a mouth opening axially endwise at the opposite axial end of said enclosure; first contact means of electrical conducting material comprising an interior electrical contact within said enclosure adjacent to said base, an exterior electrical contact externally of said enclosure, and means extending through said member and electrically connecting said interior and exterior contacts; second contact means of electrical conducting material spaced from the first contact means and fixed with respect to said enclosure, said second contact means having guide portions extending axially along said sidewalls in the direction from said base toward said mouth and effecting an interference fit with said sidewalls, said guide portions terminating in said direction in portions closing said mouth and defining a second exterior contact; and means for selectively completing an electrical connection between said guide portions and said interior contact comprising gravity actuated contact means movable axially along said guide portions in electrical contact therewith to and from positions of electrical contact with said interior contact in accordance with the inclination of said axis.

2. A switch according to claim 1, said second exterior contact comprising a cup-shaped conductor having a base and axially extending sidewalls, the latter base being located axially outwardly of said mouth, the latter sidewalls and the sidewalls of said member telescoping coaxially one within the other at an interference fluid sealing fit for closing said mouth.

3. A switch according to claim 2, said member comprising a one-piece injection molded plastic, said first contact means comprising a molded insert within said base, said sidewalls of said member and said guide portions comprising coaxial cylindrical portions, and said guide portions comprising extensions of the sidewalls of said cup-shaped conductor.

4. A switch according to claim 1, the sidewalls of said member being cylindrical in sections transverse to said axis, said second contact means comprising a cup-shaped conductor having a base at one axial end, a mouth opening axially at the opposite axial end, and cylindrical sidewalls closely fitting coaxially in telescoping fluid sealing relationship with the sidewalls of said member, the mouth of said cup-shaped conductor opening toward the base of said member, and the base of said cup-shaped conductor comprising said second exterior contact and being spaced axially endwise from the mouth of said member.

5. A switch according to claim 4, said interior and exterior contacts of said first contact means being located adjacent opposite axial sides of the base of said housing.

6. A switch according to claim 1, said base being cylindrical, the sidewalls of said member being coaxially cylindrical with said base and having a reduced external diameter with respect to said base, said sidewalls extending axially from said base to said mouth and defining said enclosure, said second contact means comprising a cup-shaped conductor having a base at one axial end, a mouth opening axially at the opposite axial end, and cylindrical sidewalls closely fitting coaxially around the sidewalls of said member in fluid sealing engagement therewith, the mouth of said cup-shaped conductor opening toward the base of said member and being closed thereby, and the base of said cup-shaped conductor comprising said second exterior contact.

7. A switch according to claim 6, said base of said member providing an annular shoulder around said cylindrical sidewalls of reduced external diameter, the sidewalls of said cup-shaped conductor at the mouth thereof abutting said shoulder, and the base of said cup-shaped conductor being spaced axially endwise from the mouth of said member.

8. A switch according to claim 6, the base of said member having an outer circumference comprising the maximum radial extent of said switch, the outer circumference of the cylindrical sidewalls of said second contact means having said maximum radial extent and being supported on the last named base around said mouth of said cup-shaped conductor.

9. A switch according to claim 8, said gravity actuated contact means comprising a spherical ball, said interior electrical contact comprising a spherical surface having a radius comparable to the radius of said ball and arranged to make a tangent point electrical contact with said ball.

10. A switch according to claim 9, the diameter of said ball being less than but on the order of magnitude of the internal diameter of the cylindrical sidewalls of said cup-shaped conductor, said reduced diameter sidewalls of said member extending coaxially from said base for an axial distance on the order of magnitude of the radius of said ball.

11. A switch according to claim 6, said interior contact having a rounded contact surface spaced axially from said base and terminating adjacent to the mouth of said member.

12. A gravity switch comprising:

(A) a cylindrical shell member of conductive material closed at one end and open at the other end;

(B) a base member of dielectric material closing the open end of said shell member;

(C) an electrical contact extending axially through said base member to present a contact tip surface located adjacent the open end of said shell member on the central axis of that member; and (D) a ball of conductive material positioned rollably within said shell member and having a diameter which is slightly less than the inner diameter of said shell member and more than half of the shortest distance between said contact tip surface and the inner surface of the closed end of said shell member.

13. A gravity switch according to claim 12 wherein (E) said base member includes a circular base portion having an outer diameter which is substantially the same as the outer diameter of said shell member and sidewall portions extending axially from said base portion having a reduced external diameter with respect to said base portion and forming a shoulder between the outer diameter of said base portion and the outer diameter of said sidewall portions having a radial dimension substantially the same as the wall thickness of the walls of said shell member, said shell walls telescoped around said sidewalls and terminating against said shoulder on said base portion in fluid sealing relationship thereby forming a uniform external diameter throughout the length of said switch.

* * * * *